United States Patent [19]

Jochum et al.

[11] 4,214,546

[45] Jul. 29, 1980

[54] CONVERTIBLE AMPHIBIOUS VEHICLE

[75] Inventors: Friedrich Jochum, Kaiserslautern; Heinz Glaser, Pflaumheim, both of Fed. Rep. of Germany

[73] Assignee: Maschinenfabrik Buckau R. Wolf Aktiengesellschaft, Grevenbroich, Fed. Rep. of Germany

[21] Appl. No.: 879,870

[22] Filed: Feb. 21, 1978

[30] Foreign Application Priority Data

Mar. 8, 1977 [DE] Fed. Rep. of Germany ..... 2709948

[51] Int. Cl.[2] ..... B60F 3/00

[52] U.S. Cl. ..... 114/270

[58] Field of Search ..... 115/1 R, 1 B; 296/10, 296/43

[56] References Cited

U.S. PATENT DOCUMENTS

| | | | |
|---|---|---|---|
| 1,631,118 | 6/1927 | Burkart | 296/43 |
| 3,152,569 | 10/1964 | Gehlen et al. | 115/1 R |
| 3,661,114 | 5/1972 | Wagner et al. | 115/1 B |

FOREIGN PATENT DOCUMENTS

| | | | |
|---|---|---|---|
| 1111048 | 12/1959 | Fed. Rep. of Germany | 115/1 B |
| 864857 | 4/1961 | United Kingdom | 115/1 B |

*Primary Examiner*—Sherman D. Basinger
*Attorney, Agent, or Firm*—Michael J. Striker

[57] ABSTRACT

An amphibious truck includes an arrangement for converting same into a pontoon or ferry vehicle. The converting arrangement comprises two elongated U-shaped support bars arranged on opposite ends of the platform of the truck and transversely to the longitudinal axis of the vehicle and each end of the bar supports for rotation in a plane perpendicular to the platform a triangular guiding member. Stacked on the platform, between the support bars, are two floats which are linked at their ends to the assigned triangular guiding members by hydraulic cylinders. Additional pairs of hydraulic cylinders are linked between a central point of the respective support bars and the free apexes of the triangular guiding members. The resulting hydraulically controlled power transmission link is expandable between the floats and the platform in a plane perpendicular to the bars and makes it possible to tilt the floats into an operative position in alignment with the platform.

6 Claims, 5 Drawing Figures

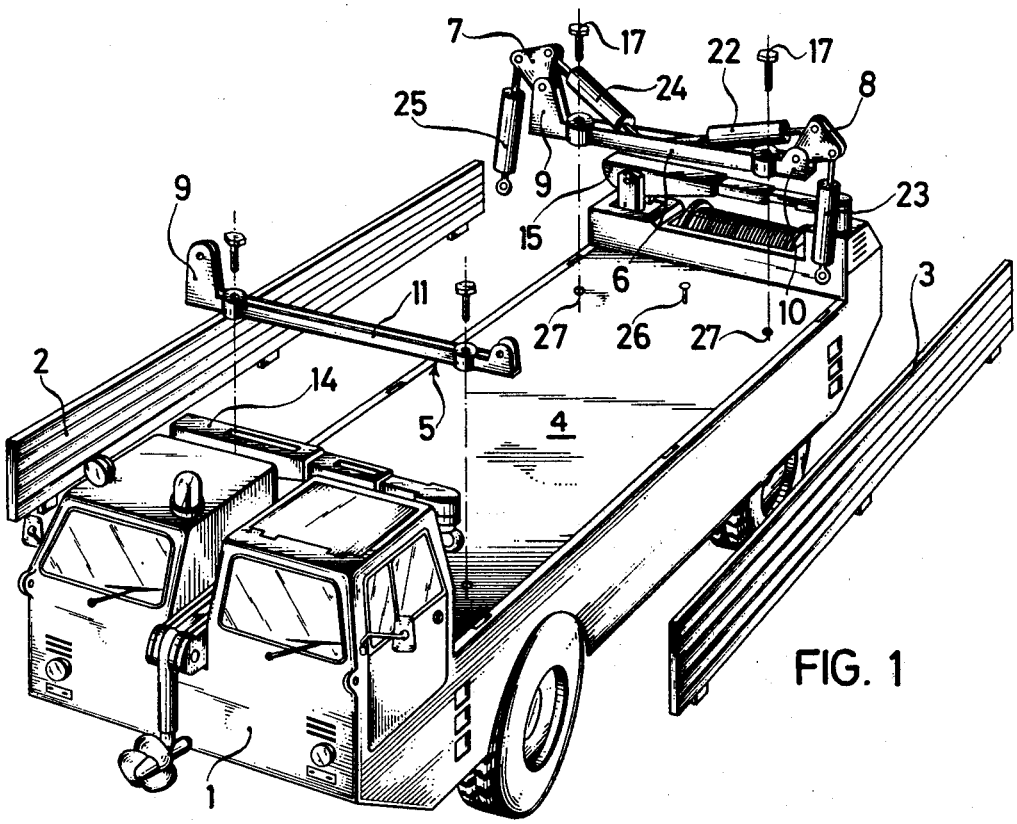
FIG. 1
FIG. 2
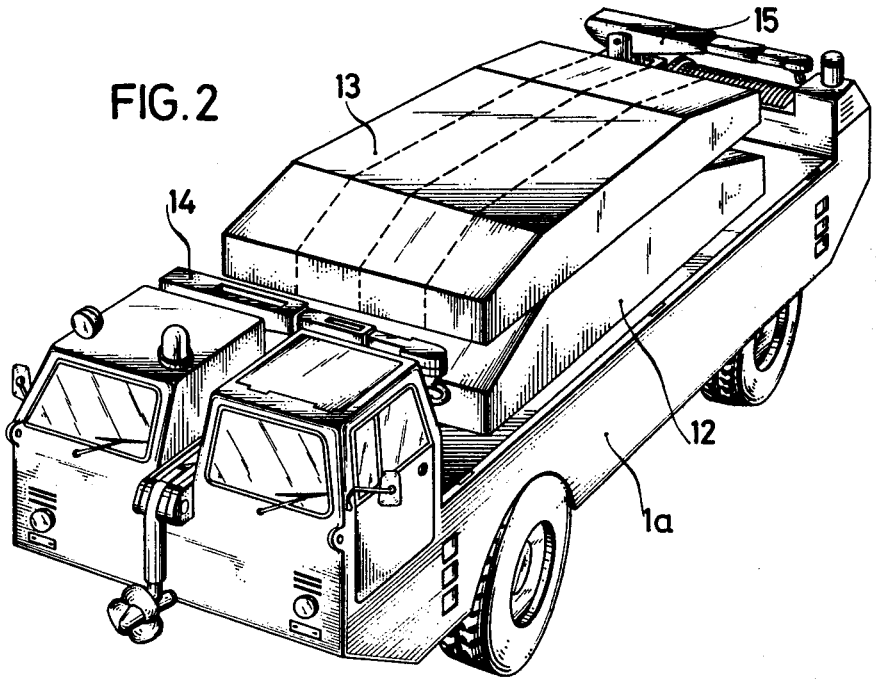

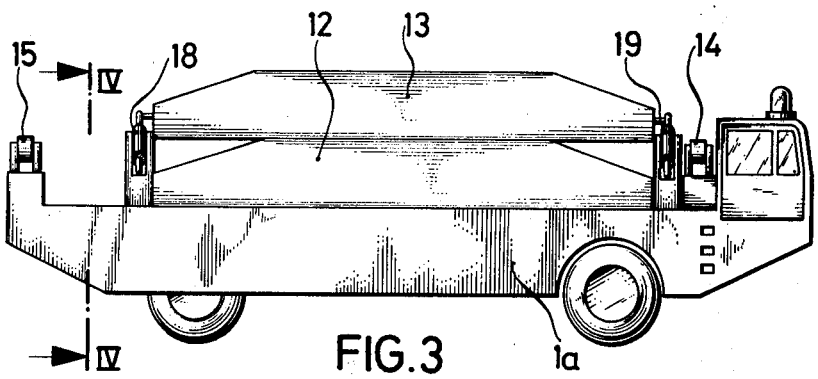
FIG.3
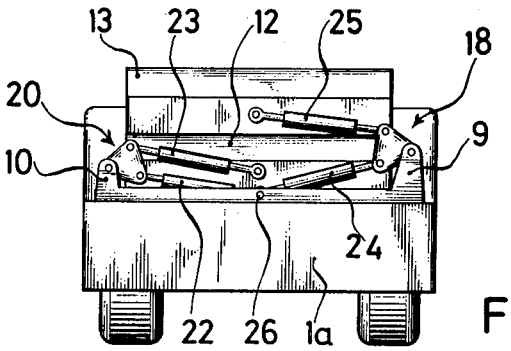
FIG.4
FIG.5
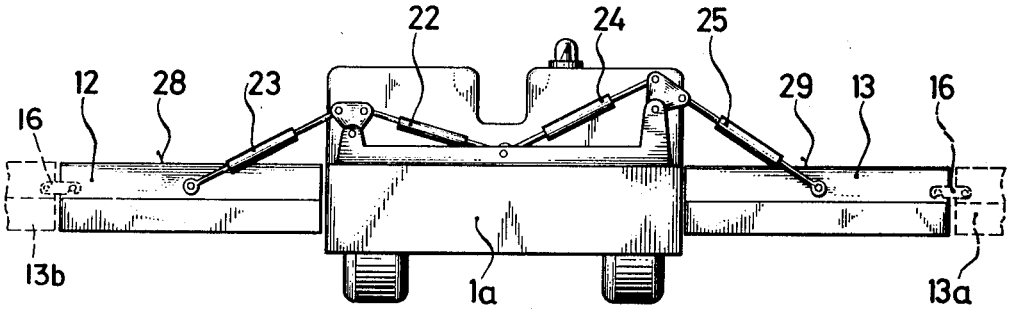

CONVERTIBLE AMPHIBIOUS VEHICLE

BACKGROUND OF THE INVENTION

The invention relates generally to amphibious vehicles and, more particularly, it relates to an amphibious pontoon or ferry vehicle carrying at least two floats which during the land travel of the vehicle are stacked one above the other above the frame of the vehicle, whereas during the travel in water the floats are folded laterally to extend in alignment with the deck or platform of the vehicle to form a roadway.

In known embodiments each float is hinged to one side of the vehicle by means of two links firmly connected to the body of the vehicle and each link always includes two hydraulic cylinders which at one end thereof are linked to a triangular guiding member and at the other ends thereof are linked between the body of the vehicle and the floats.

Amphibious vehicles of this kind have been employed for briding a river from any point on its bank. During the travel on land the floats are stacked on the vehicle body. On reaching the place of destination the floats have to be brought quickly and securely into their unfolded condition. For this purpose, in prior art vehicles, the floats have been tilted in their hinges by hydraulic cylinders. In a known vehicle of this type (German Offenlegungsschrift No. 2,302,880) the tilting has been effected by means of a triangular guiding member. The use of an angular lever for the tilting movement has been also suggested in German Offenlegungsschrift No. 2,318,139 and in the published German patent application No. 2,135,910.

Amphibious vehicles have been used also for loading and unloading ocean ships. In order to facilitate, by the aid of the amphibious vehicles, the loading and unloading of operation ocean ships from any point of the seashore it has been suggested to use amphibious trucks for transporting cargo from freighters lying in an anchorage, to places of destination on the land and vice versa. The merchandise to be shipped is transported by such amphibious trucks from various sites on the land to the freighters in the anchorage.

In developing countries for example, there frequently takes place deliveries of heavy duty trucks, bulldozers or other heavy duty construction machines and, in many cases, there are insufficient loading or unloading structures on the wharf to handle such overweight loads. But even if suitable harbor equipment for unloading the excessively heavy pieces are available on the wharf, the absence of roads which would enable the transportation of such equipment over distances amounting to several hundred kilometers from the harbor to a place of destination, makes the use of heavy duty amphibious trucks desirable.

SUMMARY OF THE INVENTION

It is an object of this invention to provide means which makes it possible to convert quickly and without trouble, a conventional amphibious vehicle into a pontoon or heavy-duty ferry vehicle.

Another object of this invention is to provide amphibious trucks which are capable of loading or unloading ocean freighters lying in an anchorage and transporting the unloaded cargo to and from even remote places on land.

In keeping with these objects and others which will become apparent hereafter, one feature of the invention resides in a combination of an amphibious truck, such as for example a conventional amphibious truck having removable drop sides, with two support bars detachably connected to the deck or platform of the truck at the opposite end portion thereof and pivotally connecting to the ends of the bars triangular guiding members for linking respective pairs of hydraulic cylinders. The cylinders are linked between a central portion of the supporting bar and the end surfaces of respective floats, to enable folding the floats into a rest position in which the floats are stacked on the platform of the truck, and to swing the floats into an unfolded position in which the floats project laterally from the body of the vehicle in alignment with the platform.

By this means it is possible to employ conventional amphibious trucks for laying bridges between the shore and ocean freighters lying in an anchorage. In this manner it is also possible to transfer heavy duty machinery and vehicles directly, simply and quickly between a marine vessel and any point of the seashore. If the ocean freighters or other marine vessels are provided with lateral loading hatches the pontoon bridges can be directed immediately to respective hatches and in this case heavy duty vehicles constituting the or part of the cargo may drive out of the hold under their own power and directly onto the pontoon bridge (or vice versa), so that the inconvenient and time-consuming loading or unloading operation by the aid of onboard cranes can be saved.

In a preferred embodiment of the device of this invention for converting amphibious trucks into amphibious pontoon vehicles, the supporting bars have a substantially U-shaped configuration whereby the leg connecting the upwardly projecting flanges has such a span as to extend over approximately the entire width of the platform of the vehicle and the two end flanges have bore holes for pin-jointing the triangular guiding members, the bore holes being arranged on different levels so that the hydraulic cylinders might be accommodated one above the other during the unfolded state of the floats.

In most cases the floats by themselves are not adequate for forming a sufficient ramp for vehicles on the shore to enter the pontoon bridge. To avoid this disadvantage the amphibious truck may be provided with its own onboard cranes by means of which ramp parts (which are also stored on the platform along the longitudinal axis of the vehicle) can be lifted and linked to the unfolded float.

Amphibious trucks stationed in remote places without roads, as may frequently occur in developing countries, cannot rely upon an ample technical service. For this reason it is important that the crew of such amphibious vehicles be able to help themselves and for this purpose onboard auxiliary cranes are provided on the vehicle. Such auxiliary cranes facilitate the conversion of the amphibious truck into a pontoon vehicle of this invention or vice versa so that the conversion can be made independent of service stations.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

BRIEF DESCRIPTION OF THE DRAWING

FIG. 1 is a perspective view of an amphibious truck before its conversion into a pontoon vehicle;

FIG. 2 is a perspective view of an amphibious pontoon according to this invention having folded floats;

FIG. 3 is a side view of the vehicle of FIG. 2;

FIG. 4 is a sectional view along line IV—IV of FIG. 3; and

FIG. 5 is a sectional view similar to FIG. 4 but showing unfolded floats.

DESCRIPTION OF THE PREFERRED EMBODIMENTS

Referring to the Figures, to convert a conventional amphibious truck 1 (FIG. 1) having a deck or platform 4 with two removable drop sides 2 and 3, into an amphibious pontoon vehicles 1*a* (FIG. 2), the drop sides 2 and 3 are first removed and thereupon two U-shaped support bars 5 and 6 are placed transversely at opposite end portions of the deck 4 and secured to the vehicle body by fasteners 17 passing through bore holes 27. The support bars 5 and 6 consist preferably of a transverse arm 11 having at one end thereof an upwardly directed flange 9 and at the other end an upwardly directed flange 10 that is shorter than the opposite flange 9. Triangular linking members or guides 7 are hinged to the longer flanges 9 and triangular guides 8 are hinged to the short flanges 10 so that the guides 7 and 8 may rotate in a plane perpendicular to the arm 11. Hydraulic cylinders 24 and 25 are pivotably connected at one end thereof to the free apexes of the triangular guide 7 and a corresponding pair of hydraulic cylinders 22 and 23 is hinged to the free apexes of the guide 8. The free ends of cylinders 22 and 24 are subsequently hinged at point 26 to the platform 4 (FIG. 1) and are pin-jointed to a center point of arms 11 as seen most clearly from FIGS. 4 and 5. The free ends of hydraulic cylinders 25 are hinged respectively to the opposite end surfaces of the float 13 whereas the free ends of cylinders 23 are hinged to the end surfaces of the float 12. By means of a suitable hydraulic driving system having a quick coupling device (not shown in the drawing) cylinders 22 to 25 are actuated to extend and unfold the floats 12 and 13. As can be seen from FIGS. 3 to 5, the resulting articulated hydraulic power transmission link 18 and 20 links each float 12 and 13 to the supporting arm and thereby to the body of the vehicle.

In the unfolded condition of the floats 12 and 13 as shown in FIG. 5, the upper surfaces 28 and 29 of the floats together with the platform surface 4 of the vehicle 1*a* form a passable driveway. As indicated by dashed lines in FIG. 5, the extended floats of one vehicle, here 13, can be connected by means of a coupling 16 to a float, here 13*a*, of another vehicle so that the resulting pontoon bridge can be extended to any desired length. Two or more vehicles coupled in the above-described manner can be also used as heavy-duty ferries for loading and unloading ocean freighters.

In order to convert the amphibious pontoon of this invention into an ordinary amphibious truck, it is only necessary to loosen the fastening devices 17 connecting the support arms 11 to the vehicle and to disassemble pin jointed connections at the ends of hydraulic cylinders and at the end surfaces of the floats 12 and 13. Subsequently, by the aid of onboard cranes 14 and 15 the support bars 5 and 6 may be lifted together with guides 7 and 8 and hinged hydraulic cylinders 22 to 25, and unloaded from the vehicle. Also, the floats 12 and 13 can be displaced by means of the cranes 14 and 15 and unloaded. Upon the reinsertion of drop sides 2 and 3 into their place on the vehicle, the original amphibious truck is reinstated. Since the conversion is possible by the aid of hoisting devices available on the vehicle itself, the conversion process can take place at any arbitrary place at the seashore, without any outer assistance.

In most cases the floats 12 and 13 by themselves are not adequate for forming a sufficient ramp for vehicles on the shore to enter the pontoon bridge. To avoid this, the amphibious truck 1 may be provided with ramp parts which can also be stored on the platform 4 along the longitudinal axis of the vehicle. These parts can be lifted by the cranes 14 and 15 and linked to the unfolded floats. This is shown at the left side in FIG. 5, wherein one ramp part 13*b* is linked by the coupling 16 to the float 12.

While the invention has been illustrated and described as embodied in an amphibious truck, it is not intended to be limited to the details shown, since various modifications and structural changes may be made without departing in any way from the spirit of the present invention. In particular, applications other than those mentioned will suggest themselves. For example, the invention may be employed in erecting emergency bridges or assault bridges for crossing rivers or lakes.

Without further analysis, the foregoing will so fully reveal the gist of the present invention that others can, by applying current knowledge, readily adapt it for various applications without omitting features that from the standpoint of prior art, fairly constitute essential characteristics of the generic or specific aspects of this invention.

What is claimed as new and desired to be protected by Letters Patent is set forth in the appended claims:

1. An amphibious vehicle comprising a platform; a hydraulic driving system; and means for converting the amphibious vehicle into a pontoon or ferry vehicle and actuated by said hydraulic driving system, said converting means having two floats movable between an inoperative position in which said floats are folded and stacked on said platform and an operative position in which said floats are unfolded and the top surfaces of said floats are in alignment with the top surface of said platform, said converting means further having means for connecting said floats to said platform and moving the former between said inoperative and operative positions, said connecting and moving means including a pair of elongated support members arranged to extend transversely to the longitudinal axis of the vehicle, triangular guiding members each hinged at one apex thereof to an assigned end of the support members for rotation in a plane perpendicular to said support member, and four pairs of hydraulic cylinders hinged respectively between end surfaces of said floats, the free apexes of said triangular guiding members and a center point of said support members to provide articulated links expandable and retractable for unfolding and folding said floats, respectively, said elongated support members being detachably connectable to said platform so as to readily move between a first position in which said support members are unfastened and together with said guiding members and said hydraulic cylinders removed from said platform so that the vehicle serves as an amphibious vehicle, and a second position in which said support members are fastened to said platform and together with said guiding members and hydraulic cylinders are held on the latter to fold and unfold said floats so that the vehicle serves as a pontoon or ferry vehicle.

2. An amphibious vehicle as defined in claim 1, wherein said supporting members are elongated rods having a substantially U-shaped configuration defining a straight arm terminated at its opposite ends by two upwardly directed flanges, the length of said arms corresponding approximately to the width of said platform of the vehicle and the end portions of said flanges including devices for pivotably supporting said triangular guiding members.

3. An amphibious vehicle as defined in claim 1; further including parts for assembling an auxiliary ramp, said parts being disposed on said platform.

4. An amphibious vehicle as defined in claim 3; further comprising auxiliary cranes secured to the vehicle for loading and unloading said converting means.

5. An amphibious vehicle as defined in claim 3, wherein the floats and the ramp parts are provided with coupling means for connecting the sides of said floats to corresponding sides of floats of adjacent amphibious pontoon vehicles and to said ramp parts, thus forming a passable pontoon bridge or an auxiliary ferry vehicle.

6. An amphibious vehicle as defined in claim 1, wherein the amphibious vehicle includes removable drop sides that are removed prior to the application of said converting means.

* * * * *